US011555363B2

(12) United States Patent
Hicks et al.

(10) Patent No.: US 11,555,363 B2
(45) **Date of Patent: *Jan. 17, 2023**

(54) ARTIFICIAL LIFT ASSEMBLY

(71) Applicant: IPI TECHNOLOGY LLC, Oklahoma City, OK (US)

(72) Inventors: Robert Hicks, Oklahoma City, OK (US); Josh Prather, Acton, CA (US)

(73) Assignee: IPI Technology LLC, Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/737,368

(22) Filed: May 5, 2022

(65) Prior Publication Data

US 2022/0259932 A1 Aug. 18, 2022

Related U.S. Application Data

(63) Continuation of application No. 16/953,712, filed on Nov. 20, 2020, now Pat. No. 11,365,597.

(60) Provisional application No. 62/942,983, filed on Dec. 3, 2019.

(51) Int. Cl.

| | |
|---|---|
| ***E21B 23/00*** | (2006.01) |
| ***E21B 43/12*** | (2006.01) |
| ***E21B 34/06*** | (2006.01) |
| ***E21B 33/12*** | (2006.01) |
| ***F04B 47/06*** | (2006.01) |

(52) U.S. Cl.

CPC ..... *E21B 23/00* (2013.01); *E21B 33/12* (2013.01); *E21B 34/063* (2013.01); *E21B 43/128* (2013.01); *F04B 47/06* (2013.01); *E21B 2200/08* (2020.05)

(58) Field of Classification Search

CPC ..... E21B 23/00; E21B 33/12; E21B 34/063; E21B 43/128; E21B 2200/08; E21B 33/1208; F04B 47/06; F04B 49/10; F04B 53/16; F04B 17/03

See application file for complete search history.

(56) References Cited

U.S. PATENT DOCUMENTS

| | | | | |
|---|---|---|---|---|
| 6,595,295 | B1 * | 7/2003 | Berry | E21B 43/128 166/105 |
| 7,048,057 | B2 | 5/2006 | Bearden et al. | |
| 7,353,879 | B2 | 4/2008 | Todd et al. | |
| 8,663,401 | B2 | 3/2014 | Marya et al. | |
| 8,770,261 | B2 | 7/2014 | Marya | |
| 8,800,668 | B2 | 8/2014 | Bouldin et al. | |
| 8,931,549 | B2 | 1/2015 | Smith | |
| 9,181,785 | B2 | 11/2015 | Lawson et al. | |
| 9,260,935 | B2 | 2/2016 | Murphree et al. | |
| 9,534,480 | B2 | 1/2017 | Hendryx | |

(Continued)

FOREIGN PATENT DOCUMENTS

WO 2016036342 3/2016

*Primary Examiner* — Steven A MacDonald
(74) *Attorney, Agent, or Firm* — McAfee & Taft

(57) ABSTRACT

An artificial lift assembly and method relating thereto is designed to prevent inadvertent electrical discharge caused by fluids flowing through an electrical submersible pumping system, which is part of the assembly. The assembly uses a rupture disc to prevent fluid flow during introduction of the assembly into a wellbore and a dart and sleeve to prevent fluid flow during removal of the assembly from the wellbore.

20 Claims, 5 Drawing Sheets

(56) References Cited

U.S. PATENT DOCUMENTS

| | | | | |
|---|---|---|---|---|
| 10,036,210 | B2 | 7/2018 | Maclean et al. | |
| 10,079,457 | B2 | 9/2018 | Yuratich | |
| 10,392,910 | B2 * | 8/2019 | Walton | E21B 34/14 |
| 2006/0011345 | A1 * | 1/2006 | Delaloye | E21B 43/08 166/310 |
| 2007/0284011 | A1 * | 12/2007 | Freyer | E21B 33/1208 138/93 |
| 2008/0164036 | A1 * | 7/2008 | Bullen | E21B 43/129 166/385 |
| 2010/0006301 | A1 * | 1/2010 | Fenton | E21B 17/1007 166/368 |
| 2013/0000899 | A1 * | 1/2013 | Broussard | E21B 33/124 166/278 |
| 2014/0182855 | A1 * | 7/2014 | Woodford | E21B 34/10 166/305.1 |
| 2020/0032599 | A1 * | 1/2020 | Biddick | E21B 23/14 |
| 2020/0284118 | A1 * | 9/2020 | Xiao | E21B 33/03 |

* cited by examiner

ARTIFICIAL LIFT ASSEMBLY

CROSS-REFERENCE TO RELATED APPLICATION

This application is a continuation of U.S. application Ser. No. 16/953,712 filed Nov. 20, 2020, now allowed, and claims the benefit of U.S. Provisional Application No. 62/942,983 filed Dec. 3, 2019, which are hereby incorporated by reference.

FIELD

The present disclosure relates generally to artificial lift assemblies using electrical submergible pumps (ESP), and in particular, to sealing devices used in relation to ESP systems.

BACKGROUND

In subsurface wells, such as oil wells, an electrical submersible pump with a motor (ESP) is often used to provide an efficient form of artificial lift to assist with lifting the production fluid to the surface. ESPs decrease the pressure at the bottom of the well allowing for more production fluid to be produced to the surface than would otherwise be produced if only the natural pressures within the well were utilized.

The typical electrical submersible pump installation consists of a downhole gauge (sensor) to monitor pressure and temperature, connected to a motor that drives a single or double seal, also known as a protector. The protector inhibits oil ingress into the motor while permitting pressure equalization between the well annulus and motor connected to the downhole pump, typically a centrifugal pump but sometimes a progressing cavity pump, or other centrifugal or positive displacement pumps. Historically, the motor has been a 2-Pole Induction motor that has existed in the marketplace for over fifty years.

Recently, the use of permanent magnet motors has come to the forefront for use in electrical submersible pumping (ESP) in oil and gas wells. Replacing the induction motor with a permanent magnet motor is new to the oil and gas industry and offers several benefits including a higher efficiency, power factor, and increased reliability. The foundation of a permanent magnet motor is that it utilizes rare earth magnets in the rotor to enable better synchronization with the electrical current flowing through the stator thereby increasing the efficiency and power factor.

One of the pitfalls with permanent magnet motors is that during installation or pump removal, the wellbore equalizes pressure through the pump which causes rotation of the pump and subsequently the motor. When the motor spins, the magnets within the rotor spin thereby generating power which is transmitted up the cable to the surface. This can present safety issues caused by technicians being unaware that the pumping system is spinning downhole and transmitting electrical power to the surface.

SUMMARY

This disclosure generally concerns an ESP system and method relating thereto. The system is designed to prevent rotation of the pump, and subsequently the motor, during installation and removal of the ESP system.

More specifically, in accordance with one series of embodiments of the current disclosure, there is provided a method for the installation and removal of an ESP system utilizing a permanent magnet motor. The method comprises the steps of:

- introducing into a wellbore an artificial lift assembly on a tubing string, wherein the artificial lift assembly comprises:
  - an electrical submersible pumping system having a permanent magnet motor;
  - a rupture disc located in the tubing string above the electrical submersible pumping system, wherein the rupture disc prevents fluid flow through the electrical submersible pumping system to thus prevent rotation of the permanent magnet motor by the fluid flow during introduction of the artificial lift assembly; and
  - a sleeve located in the tubing string above the electrical submersible pump having an inner profile defined on an inner surface of the sleeve, wherein the inner profile is configured to mate with and lock in place a wellbore dart;
- rupturing the rupture disc after introduction of the artificial lift assembly into the wellbore so that fluid flow through the electrical submersible pumping system is allowed;
- operating the electrical submersible pumping system within the wellbore;
- introducing the wellbore dart into the wellbore such that the wellbore dart engages the sleeve and prevents fluid flow through the electrical submersible pumping system to thus prevent rotation of the permanent magnet motor by fluid flow, wherein the wellbore dart has an outer profile defined on an outer surface of the wellbore dart, the outer profile configured to mate with the sleeve such that the wellbore dart is held in place within the sleeve and prevents the fluid flow through the electrical submersible pumping system; and
- removing the artificial lift assembly from the wellbore after the wellbore dart engages the sleeve.

The wellbore dart can be dropped through the tubing or can be pumped downhole under fluid pressure.

Other embodiments are directed to the artificial lift assembly deployed on the tubing string. The artificial lift assembly comprising the above described components of the electrical submersible pumping system having a permanent magnet motor; the rupture disc located in the tubing string above the electrical submersible pumping system, the sleeve located in the tubing string above the electrical submersible pump, and the wellbore dart.

In the above embodiments, the rupture disc can be made of steel or polymer and configured to have a predetermined rupture pressure so that a fluid can be introduced in the tubing string uphole of the rupture disc after the introduction of the artificial lift assembly into the wellbore. The fluid is used to increase the pressure uphole from the rupture disc so as to exceed the predetermined rupture pressure thus rupturing the rupture disc so that fluid flow through the electrical submersible pumping system is allowed.

Alternatively, the rupture disc can be made of a degradable material such that, after the introduction of the artificial lift assembly into the wellbore, the rupture disc degrades so as to allow fluid flow through the electrical submersible pumping system.

The wellbore dart can include a plurality of collet fingers defined on the outer surface. The collet fingers interact with the inner profile of the sleeve so as to lock the wellbore dart from moving upward in the sleeve and tubing. Also, the wellbore dart can include one or more polymeric sealing sections defined on the outer surface, wherein the sealing sections provide a fluid-tight seal with the inner surface of the sleeve.

Additionally, the sleeve can have an upper end having a shoulder. The shoulder interacts with the outer surface of the wellbore dart so as to prevent downward movement of the wellbore dart past the sleeve.

BRIEF DESCRIPTION OF THE DRAWINGS

The description and embodiments are discussed with reference to the following figures. However, the figures should not be viewed as exclusive embodiments. The subject matter disclosed herein is capable of considerable modifications, alterations, combinations, and equivalents in form and function, as will be evident to those skilled in the art with the benefit of this disclosure.

FIG. 6 is a cross-sectional view of the wellbore dart of FIG. 5 illustrated within a mating sleeve.

DETAILED DESCRIPTION

Figure 1:
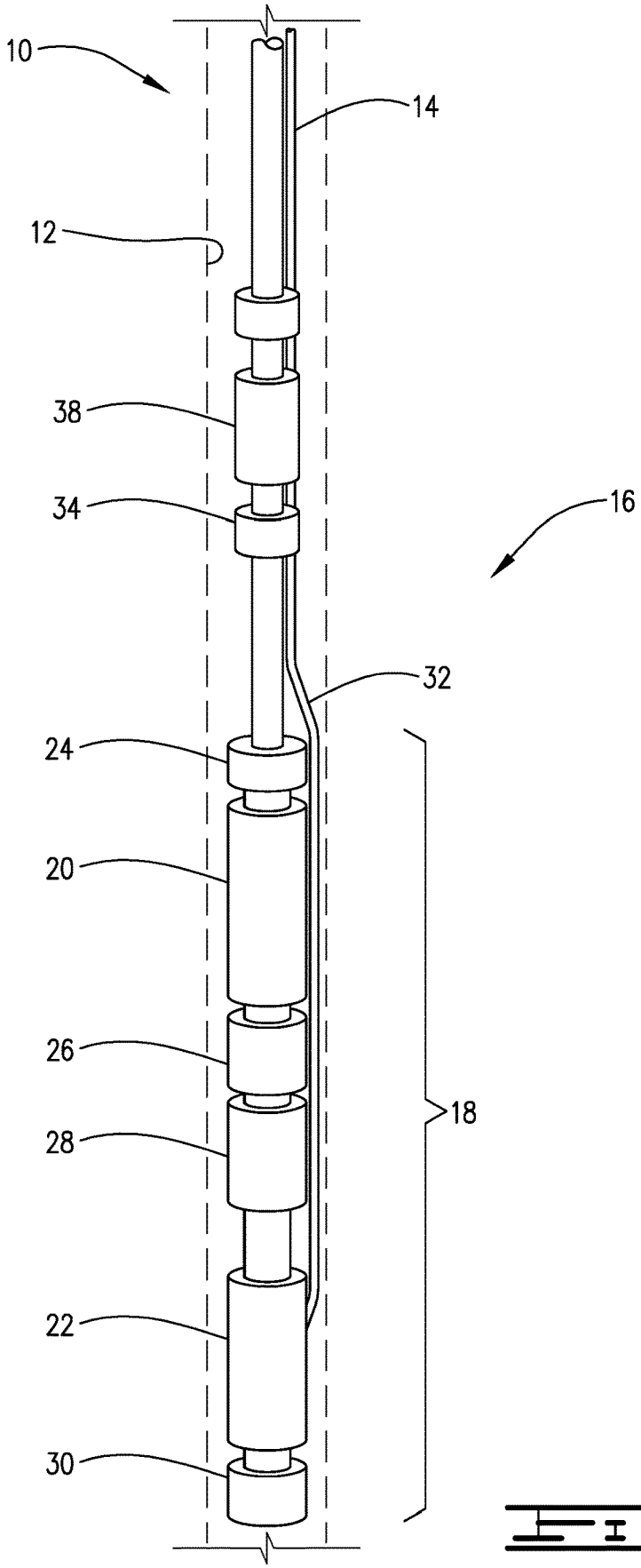
FIG. 1 schematically shows an artificial lift assembly on a tubing string in a wellbore.

In the description that follows, like parts are marked throughout the specification and drawings with the same reference numerals, respectively. The drawings are not necessarily to scale and the proportions of certain parts have been exaggerated to better illustrate details and features of the invention. Where components of relatively well-known designs are employed, their structure and operation will not be described in detail.

In the following description, the terms "inwardly" and "outwardly" are directions toward and away from, respectively, the geometric axis of a referenced object. Further, the invention will be described below with respect to an artificial lift assembly deployed on a tubing string in a wellbore, beginning at the bottom of the well and working upwards. Accordingly, reference to up or down will be made for purposes of description with "up," "upper," "upward," "upstream" or "above" meaning toward the surface and with "down," "lower," "downward," "down-hole," "downstream" or "below" meaning toward the subsurface terminal end of the wellbore, regardless of the wellbore orientation.

In the following discussion and in the claims, the terms "having," "including" and "comprising" are used in an open-ended fashion, and thus should be interpreted to mean "including, but not limited to . . . " Where words such as "consisting" or "consisting essentially of" shall be used in a closed-ended fashion. Finally, embodiments using the open-ended wording will be understood to also include embodiments using the closed-ended wording.

Referring now to FIG. 1, a well 10 comprises a wellbore 12, which may include a casing cemented therein. A tubing string 14 is lowered into wellbore 12. An artificial lift assembly 16 is deployed on tubing string 14 for use in wellbore 12. Artificial lift assembly 16 has an electrical submersible pump (ESP) 18, which includes at least a pump 20 and a permanent magnet motor 22. ESP 18 may also include components such as a discharger 24, gas separator section 26, seal section 28 and optional sensors 30, which are generally known in the art.

Pump 20 can be any of several typical pumps used for artificial lift assemblies, such as a centrifugal pump or a progressive cavity pump. While the artificial lift assembly 16 described herein can be used with any appropriate downhole motor, it is especially beneficial with permanent magnet motor 22, where the currently described artificial lift assembly 16 can help prevent unwanted discharges of electrical energy up power cable 32 when the ESP 18 is not being operated.

During operation of ESP 18, power cable 32 provides electrical power from the surface that drives permanent magnet motor 22 and hence drives the pump 20 to increase production of fluid from a subsurface reservoir. When ESP 18 is not being operated (such as when artificial lift assembly 16 is being introduced into wellbore 12 or taken out of wellbore 12), flow through pump 20 can cause rotation of pump 20 and in turn rotation of the permanent magnet in motor 22, which generates electrical energy. This electrical energy can be transmitted uphole to the surface by power cable 32 causing a safety hazard. Artificial lift assembly 16, as further described below, prevents such unwanted electrical energy transmission.

Returning now to FIG. 1, artificial lift assembly 16 includes a rupture disc 34 and a sleeve 38 uphole from ESP 18. Rupture disc 34 and sleeve 38, along with a wellbore dart 50 (shown in FIGS. 5 and 6), act to prevent unwanted electrical discharges through power cable 32.

Rupture disc 34 is located in the tubing string 14 above the ESP 18. Rupture disc 34 prevents fluid flow through the electrical submersible pumping system 18 to thus prevent rotation of the permanent magnet motor 22 by fluid flow. More specifically, rupture disc 34 prevents fluid flow through tubing string 14 and pump 20 while tubing string 14 and artificial lift assembly 16 are being introduced into wellbore 12. Once artificial lift assembly 16 is in position in the wellbore 12, rupture disc 34 is ruptured so as to allow fluid flow.

Figure 2:
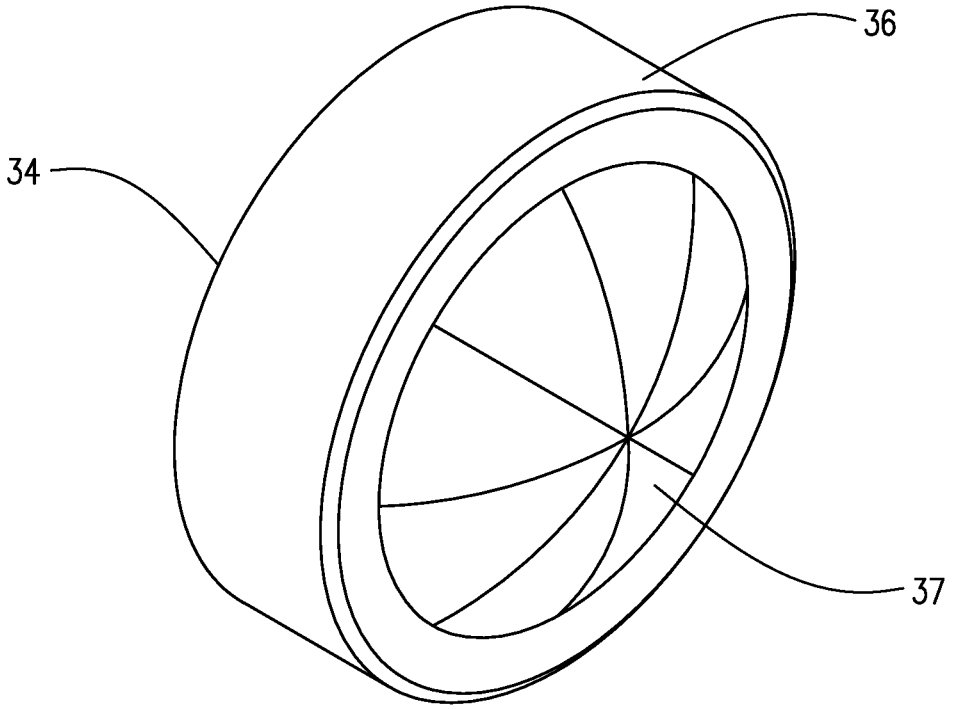
FIG. 2 is a perspective view of a rupture disc in accordance with embodiments of this disclosure.
Figure 3:
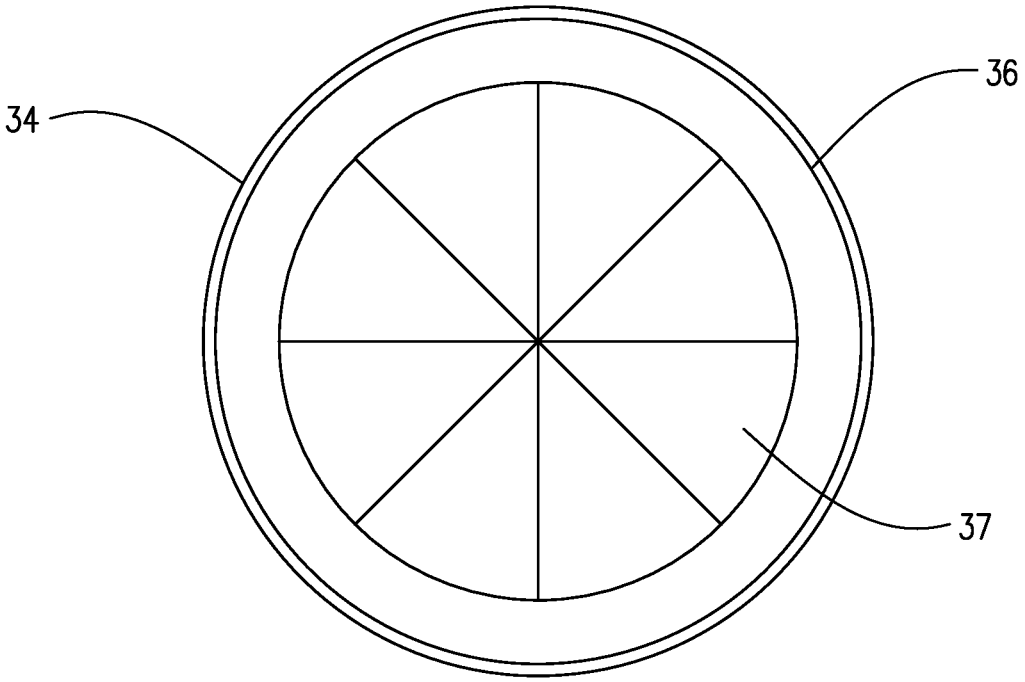
FIG. 3 is a bottom view of the rupture disc of FIG. 2.
Figure 4:
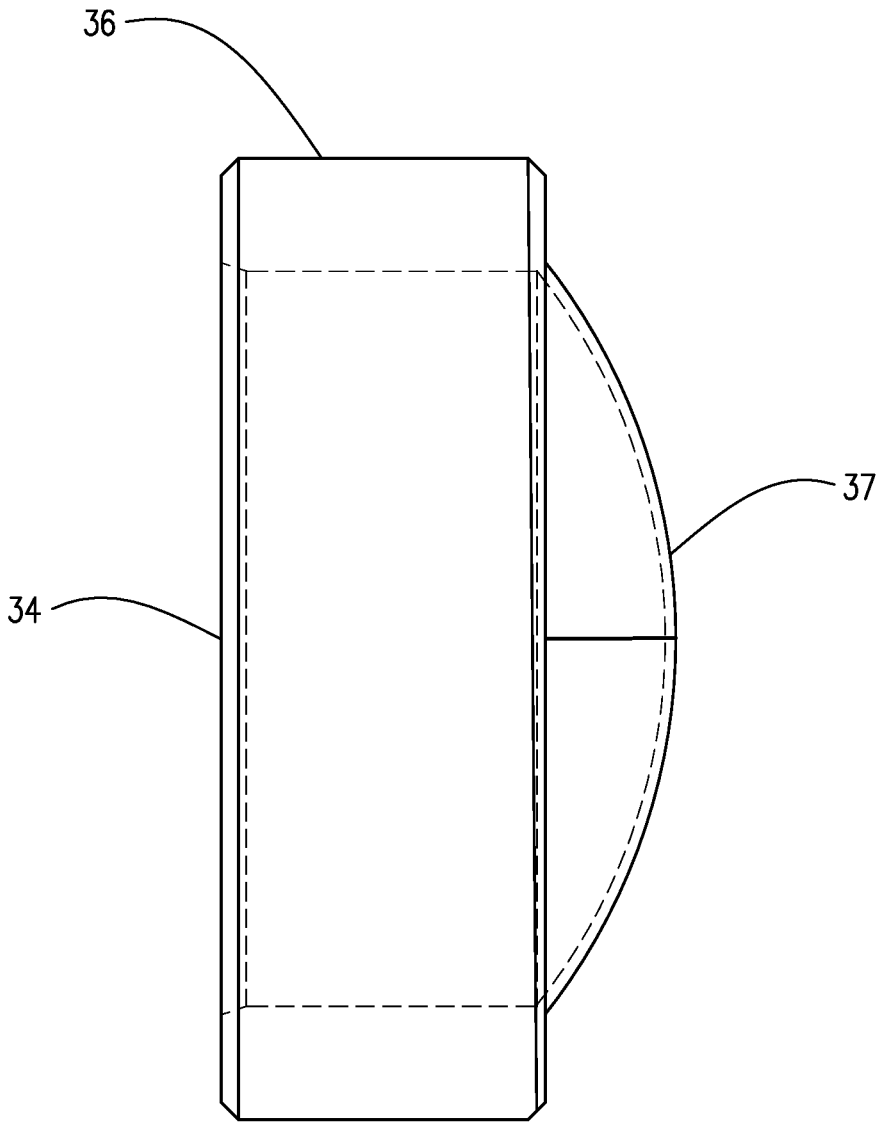
FIG. 4 is a side view of the rupture disc of FIG. 2.
Figure 4:
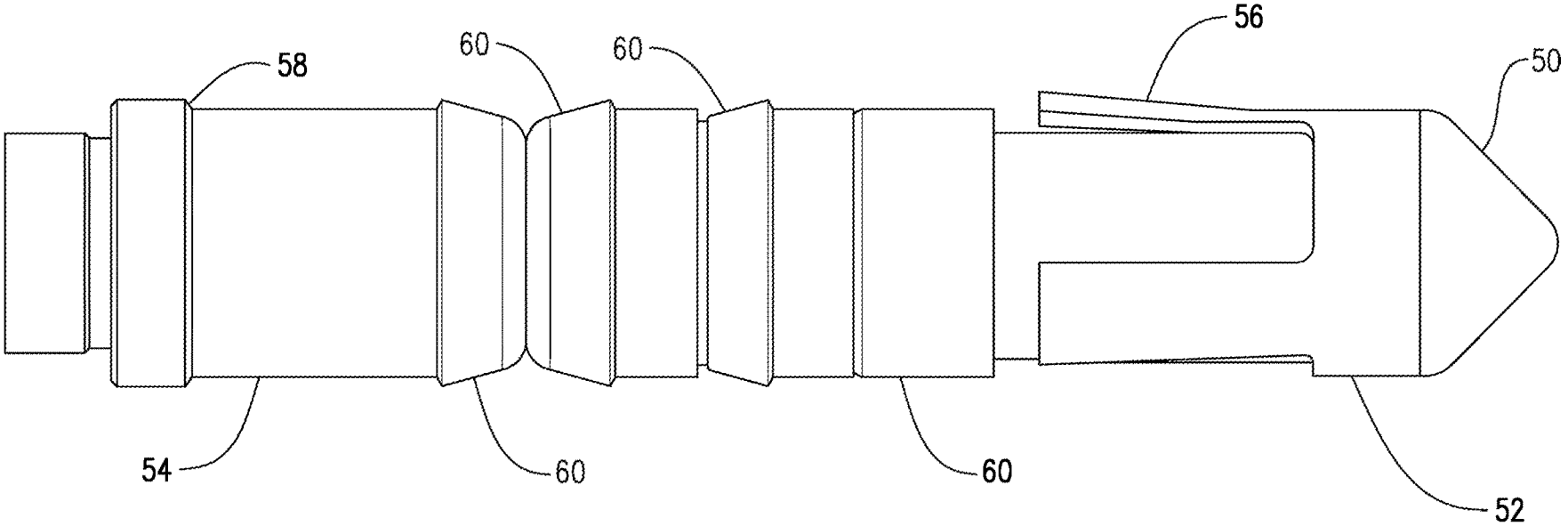

As illustrated in FIGS. 2-4, rupture disc 34 can be a disc comprised of an outer ring 36 and dome portion 37 extending across outer ring 36 so as to form a convex downhole profile. Generally, uphole from dome portion 37, rupture disc 34 will be hollow with a concave profile; thus, rupture disc 34 can be more easily ruptured by fluid pressure from uphole than by fluid pressure from downhole. Rupture disc 34 can be made of steel or polymer and is configured to have a predetermined rupture pressure such that, when fluid pressure uphole of the rupture disc exceeds the predetermined rupture pressure, the rupture disc 34 ruptures so that fluid flow through the electrical submersible pumping system 18 is allowed.

Alternatively, the rupture disc 34 can be made of a degradable material such that, after the introduction of the artificial lift assembly 16 into the wellbore 12, the rupture disc 34 degrades so as to allow fluid flow through the electrical submersible pumping system 18. The degrading or dissolving of the degradable material can be triggered by the introduction of a solvent fluid downhole or can be triggered by the ambient fluid, temperature and/or pressure conditions in the wellbore 12. Suitable degradable materials are known in the art, such as are disclosed in U.S. Pat. Nos. 8,663,401, 8,770,261, 9,260,935, and 7,353,879.

Figure 5:
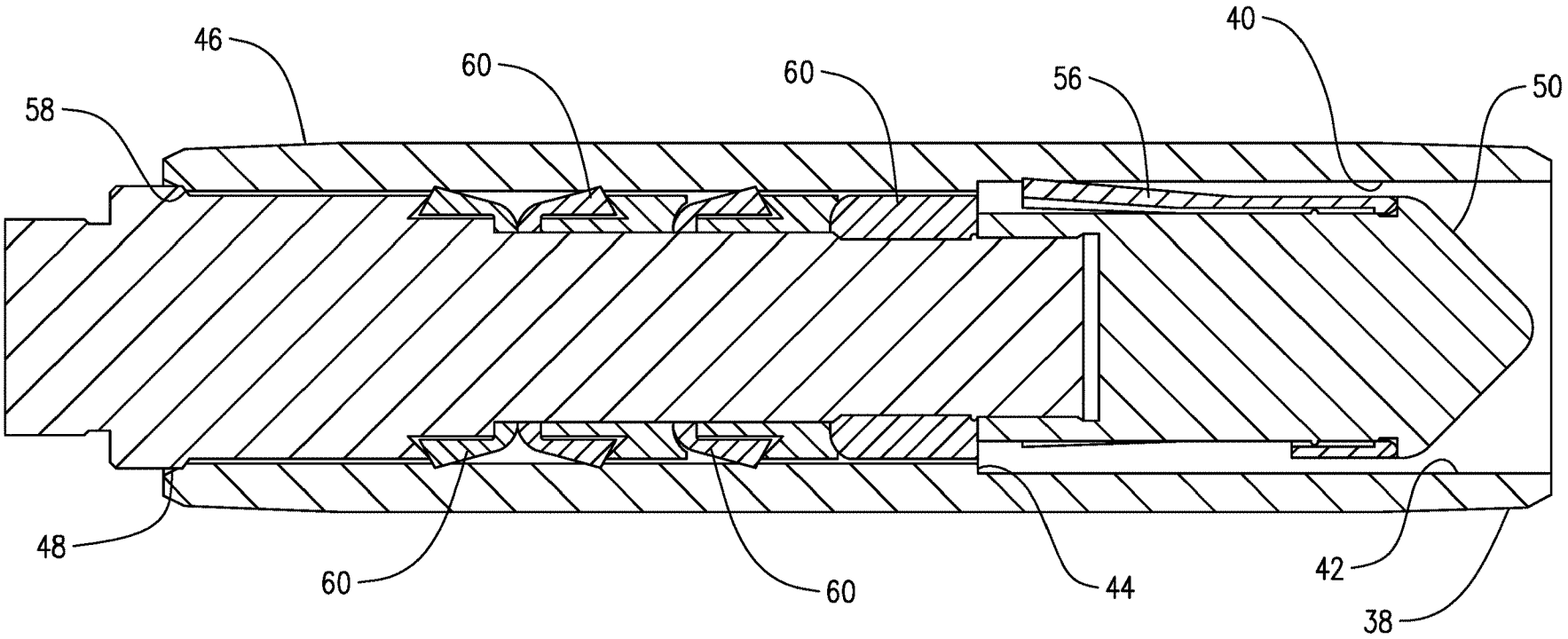
FIG. 5 is a side view of a wellbore dart in accordance with embodiments of this disclosure.

Sleeve 38 and wellbore dart 50 can be better seen in FIGS. 5 and 6. Sleeve 38 is located in the tubing string 14 above the ESP 18. Although sleeve 38 is shown above rupture disc 34 in FIG. 1, sleeve 38 can be located below rupture disc 34 instead. Additionally, it is within the scope of this disclosure for there to be multiple sleeves in tubing string 14, which accept different sizes of wellbore darts. Generally, a higher sleeve will use a large diameter wellbore dart than a lower sleeve so that the wellbore darts that mate with a lower sleeve can pass through the higher sleeve.

When a suitable mating wellbore dart 50 is introduced into sleeve 38, the wellbore dart 50 prevents fluid flow through the electrical submersible pumping system 18 to thus prevent rotation of pump 20 and hence permanent magnet motor 22. Typically, the sleeve 38 and wellbore dart 50 prevent fluid flow through tubing string 14 and motor 22 while tubing string 14 and artificial lift assembly 16 are being removed from wellbore 12. However, in some applications, a wellbore dart 50 made of degradable material (as described above) may be used to temporarily prevent rotation of the permanent magnet motor 22. Accordingly, in some embodiments, the system may comprise two or more sleeves for accepting wellbore darts and no rupture discs, or may comprise two or more sleeves for accepting wellbore darts and rupture discs.

Wellbore dart 50 has an outer profile 52 defined on an outer surface 54 of wellbore dart 50. Outer profile 52 is configured to mate with sleeve 38 when wellbore dart 50 is introduced into sleeve 38. For example, the embodiment of wellbore dart 50 illustrated in FIGS. 5 and 6 includes a plurality of collet fingers 56 defined on or forming a part of outer surface 54. Collet fingers 56 are outwardly biased and interact with inward projecting shoulder 44 so as to lock wellbore dart 50 from moving upward in the sleeve 38 and tubing string 14. Inward projecting shoulder 44 is part of inner profile 40 of inner surface 42 of sleeve 38. Further, sleeve 38 can have an upper end 46 having a shoulder 48 which mates with an opposing shoulder 58 on wellbore dart 50 so as to prevent downward movement of the wellbore dart 50 past the sleeve 38. In this manner, wellbore dart 50 is locked into place within sleeve 38.

When wellbore dart 50 is locked into place within sleeve 38, one or more polymeric sealing sections 60, which are on outer surface 54 are placed in sealing contact with inner surface 42 of sleeve 38 so as to provide a fluid-tight seal.

In operation, artificial lift assembly 16 is introduced into wellbore 12 on tubing string 14. When artificial lift assembly 16 is being introduced, rupture disc 34 is in an unruptured state so as to prevent fluid flow through electrical submersible pumping system 18 to thus prevent rotation of permanent magnet motor 22 by the fluid flow during introduction of artificial lift assembly 16. Additionally, wellbore dart 50 has not been introduced into sleeve 38.

After artificial lift assembly 16 is introduced into the wellbore and positioned therein, rupture disc 34 is ruptured to allow fluid flow through electrical submersible pumping system 18. ESP 18 can now be operated to bring well fluids uphole to the surface.

After ESP operation is complete and it is desired to remove the artificial lift assembly 16 from the wellbore 12, wellbore dart 50 is introduced into the wellbore 12 such that wellbore dart 50 engages sleeve 38 and prevents fluid flow through the electrical submersible pumping system 18 to thus prevent rotation of the permanent magnet motor 22 by fluid flow. Wellbore dart 50 can be dropped downhole to engage sleeve 38 or can be pumped down by fluid pressure into engagement with sleeve 38. After wellbore dart 50 is in place preventing fluid flow, the artificial lift assembly 16 can be removed from the wellbore.

The above elements of the tool as well as others can be seen with reference to the figures. From the above description and figures, it will be seen that the present invention is well adapted to carry out the ends and advantages mentioned, as well as those inherent therein. While the presently preferred embodiment of the apparatus has been shown for the purposes of this disclosure, those skilled in the art may make numerous changes in the arrangement and construction of parts. All such changes are encompassed within the scope and spirit of the appended claims.

What is claimed is:

1. A method comprising:

introducing into a wellbore an artificial lift assembly on a tubing string, wherein the artificial lift assembly comprises:

an electrical submersible pumping system having a permanent magnet motor;

a rupture disc located in the tubing string, wherein the rupture disc prevents fluid flow through the electrical submersible pumping system to thus prevent rotation of the permanent magnet motor by the fluid flow during introduction of the artificial lift assembly; and a sleeve located in the tubing string above the electrical submersible pump having an inner profile defined on an inner surface of the sleeve, wherein the inner profile is configured to mate with and lock in place a wellbore dart such that the wellbore dart engages the sleeve and prevents fluid flow through the electrical submersible pumping system to thus prevent rotation of the permanent magnet motor by fluid flow;

rupturing the rupture disc after introduction of the artificial lift assembly into the wellbore so that fluid flow through the electrical submersible pumping system is allowed; and operating the electrical submersible pumping system within the wellbore.

2. The method of claim 1, wherein the rupture disc is made of steel or polymer and is configured to have a predetermined rupture pressure, and wherein the method further comprises introducing a fluid in the tubing string uphole of the rupture disc after the introduction of the artificial lift assembly into the wellbore such that the pressure uphole from the rupture disc exceeds the predetermined rupture pressure thus rupturing the rupture disc so that fluid flow through the electrical submersible pumping system is allowed.

3. The method of claim 2, further comprising:

introducing the wellbore dart into the wellbore such that the wellbore dart engages the sleeve and prevents fluid flow through the electrical submersible pumping system to thus prevent rotation of the permanent magnet motor by fluid flow, wherein the wellbore dart has an outer profile defined on an outer surface of the wellbore dart, the outer profile configured to mate with the sleeve such that the wellbore dart is held in place within the sleeve and prevents the fluid flow through the electrical submersible pumping system.

4. The method of claim 3, further comprising:

removing the artificial lift assembly from the wellbore after the wellbore dart engages the sleeve.

5. The method of claim 4, wherein the wellbore dart includes:

a plurality of collet fingers defined on the outer surface, wherein the collet fingers interact with the inner profile of the sleeve so as to lock the wellbore dart from moving upward in the sleeve and tubing; and one or more polymeric sealing sections defined on the outer surface, wherein the sealing sections provide a fluid-tight seal with the inner surface of the sleeve.

6. The method of claim 5, wherein the sleeve further has an upper end having a shoulder and wherein the shoulder interacts with the outer surface of the wellbore dart so as to prevent downward movement of the wellbore dart past the sleeve.

7. The method of claim 1, wherein the rupture disc is made of a degradable material such that, after the introduction of the artificial lift assembly into the wellbore, the rupture disc degrades so as to allow fluid flow through the electrical submersible pumping system.

8. The method of claim 7, further comprising:

introducing the wellbore dart into the wellbore such that the wellbore dart engages the sleeve and prevents fluid flow through the electrical submersible pumping system to thus prevent rotation of the permanent magnet motor by fluid flow, wherein the wellbore dart has an outer profile defined on an outer surface of the wellbore dart, the outer profile configured to mate with the sleeve such that the wellbore dart is held in place within the sleeve and prevents the fluid flow through the electrical submersible pumping system.

9. The method of claim 8, further comprising:

removing the artificial lift assembly from the wellbore after the wellbore dart engages the sleeve.

10. The method of claim 9, wherein the wellbore dart includes:

a plurality of collet fingers defined on the outer surface, wherein the collet fingers interact with the inner profile of the sleeve so as to lock the wellbore dart from moving upward in the sleeve and tubing; and one or more polymeric sealing sections defined on the outer surface, wherein the sealing sections provide a fluid-tight seal with the inner surface of the sleeve.

11. The method of claim 10, wherein the rupture disk is located in the tubing string above the electrical submersible pump, and the sleeve further has an upper end having a shoulder and wherein the shoulder interacts with the outer surface of the wellbore dart so as to prevent downward movement of the wellbore dart past the sleeve.

12. An artificial lift assembly deployed on a tubing string for use in a wellbore, the artificial lift assembly comprising:

an electrical submersible pumping system having a permanent magnet motor;

a rupture disc located in the tubing string, wherein the rupture disc prevents fluid flow through the electrical submersible pumping system to thus prevent rotation of the permanent magnet motor by the fluid flow; and a sleeve located in the tubing string above the electrical submersible pump having an inner profile defined on an inner surface of the sleeve, wherein the inner profile is configured to mate with and lock in place a wellbore dart such that, when the wellbore dart is introduced into the sleeve, the wellbore dart is held in place within the sleeve and prevents fluid flow through the electrical submersible pumping system to thus prevent rotation of the permanent magnet motor by the fluid flow.

13. The artificial lift assembly of claim 12, wherein the rupture disc is made of steel or polymer and is configured to have a predetermined rupture pressure such that, when fluid pressure uphole of the rupture disc exceeds the predetermined rupture pressure, the rupture disc ruptures so that fluid flow through the electrical submersible pumping system is allowed.

14. The artificial lift assembly of claim 13, further comprising:

the wellbore dart having an outer profile defined on an outer surface of the wellbore dart, the outer profile configured to mate with the sleeve such that, when the wellbore dart is introduced into the sleeve, the wellbore dart is held in place within the sleeve and prevents fluid flow through the electrical submersible pumping system to thus prevent rotation of the permanent magnet motor by the fluid flow.

15. The artificial lift assembly of claim 14, wherein the wellbore dart includes:

a plurality of collet fingers defined on the outer surface, wherein the collet fingers interact with the inner profile of the sleeve so as to lock the wellbore dart from moving upward in the sleeve and tubing; and one or more polymeric sealing sections defined on the outer surface, wherein the sealing sections provide a fluid-tight seal with the inner surface of the sleeve.

16. The artificial lift assembly of claim 15, wherein the sleeve further has an upper end having a shoulder and wherein the shoulder interacts with the outer surface of the wellbore dart so as to prevent downward movement of the wellbore dart past the sleeve.

17. The artificial lift assembly of claim 12, wherein the rupture disc is made of a degradable material such that, after the introduction of the artificial lift assembly into the wellbore, the rupture disc degrades so as to allow fluid flow through the electrical submersible pumping system.

18. The artificial lift assembly of claim 17, further comprising:

the wellbore dart having an outer profile defined on an outer surface of the wellbore dart, the outer profile configured to mate with the sleeve such that, when the wellbore dart is introduced into the sleeve, the wellbore dart is held in place within the sleeve and prevents fluid flow through the electrical submersible pumping system to thus prevent rotation of the permanent magnet motor by the fluid flow.

19. The artificial lift assembly of claim 18, wherein the wellbore dart includes:

a plurality of collet fingers defined on the outer surface, wherein the collet fingers interact with the inner profile of the sleeve so as to lock the wellbore dart from moving upward in the sleeve and tubing; and one or more polymeric sealing sections defined on the outer surface, wherein the sealing sections provide a fluid-tight seal with the inner surface of the sleeve.

20. The artificial lift assembly of claim 19, wherein the rupture disk is located in the tubing string above the electrical submersible pump, and the sleeve further has an upper end having a shoulder and wherein the shoulder interacts with the outer surface of the wellbore dart so as to prevent downward movement of the wellbore dart past the sleeve.

* * * * *